United States Patent [19]

Commiant

[11] 4,083,280

[45] Apr. 11, 1978

[54] APPARATUS FOR TREATING FRUITS AND VEGETABLES

[75] Inventor: Michel Commiant, Brussels, Belgium

[73] Assignee: Compagnie Generale Belge des Isolants, St. Gillis-Brussels, Belgium

[21] Appl. No.: 728,748

[22] Filed: Oct. 1, 1976

[30] Foreign Application Priority Data

Oct. 1, 1975 Belgium ..... 834094

[51] Int. Cl.[2] ..... B26D 3/26; B26D 7/06

[52] U.S. Cl. ..... 83/425.3; 83/431; 83/437

[58] Field of Search ..... 83/431, 425.2, 425.3, 83/437

[56] References Cited

U.S. PATENT DOCUMENTS

| | | | |
|---|---|---|---|
| 1,947,153 | 2/1934 | Dellinger | 83/437 |
| 2,130,646 | 9/1938 | Janke | 83/437 X |

FOREIGN PATENT DOCUMENTS

| | | | |
|---|---|---|---|
| 94,483 | 2/1939 | Sweden | 83/431 |

*Primary Examiner*—Willie G. Abercrombie
*Attorney, Agent, or Firm*—Bacon & Thomas

[57] ABSTRACT

Disclosed is an apparatus for the preparation of food such as slicing, cutting, and squeezing of fruits and vegetables comprising a pressure piece, a receiving element, a toothed wheel assembly having a control lever and two racks mounted in a housing having essentially two detachable parts such that the lower part forms the base upon which is mounted a rack which is fixed in relation to the receiving element and the upper part forms a cover in which is mounted a second rack which is fixed in relation to the pressure piece wherein the cover has an opening for the passage of fruits or vegetables into an area between the pressure piece and the receiving element, and whereby movement of the lever turns the toothed wheel assembly between the two racks causing displacement of the racks in opposite directions and the subsequent movement of the pressure piece and fruit and vegetables against and through the receiving element.

14 Claims, 5 Drawing Figures

APPARATUS FOR TREATING FRUITS AND VEGETABLES

The invention refers to a device for the preparation of fruit and vegetables, particularly designed for cutting potatoes for French-frying, and consisting mainly in a pressure piece controlled by a lever, and a receiving element into which the said pressure piece forces the fruit or vegetable being prepared.

The object of this invention is to introduce such a device which is primarily intended for home use and which allows preparation of fruit and vegetables, such as cutting raw potatoes in pieces, without considerable effort.

The invention is intended, according to a particular design, to introduce a potato cutter which, because of a constant lever ratio, permits, for any given position of the mobile pressure piece in relation to the receiving element, to obtain the same ratio between the force exerted on the lever and the force transmitted to the pressure piece. Thus it is possible to reduce to a minimum the force exerted on the lever, usually by choosing the proper length for the said lever.

First of all, the potato cutters designed for home use and presently known have a great disadvantage in this area. The said lever ratio varies in fact according to the position of the mobile pressure piece in relation to the receiving element (which, in the case at hand, consists in a steel wire lattice) and in such a way that, when the pressure to be exerted on the potato should be the greatest, the lever ratio is minimum, so that a considerable effort must be exerted on the lever. On this subject, it can be demonstrated by experiments that the effort to be exerted on the potato must be maximum at the beginning of the operation; this is especially true when the potato is rather large.

In this invention, this disadvantage is prevented by mounting the lever on a toothed wheel moving freely between two racks parallel to the direction of the pressure piece, in such a way that one of these racks is fixed in relation to the receiving element and the other, fixed in relation to the pressure piece.

In the preferred design of this invention, the parts of the device consisting of the pressure piece, the receiving element, the toothed wheel and the two racks are mounted in a housing composed essentially of two parts placed one on top of the other and easily detachable, so that the lower part forms the base on which is mounted the rack which is fixed in relation to the receiving element, and so that the upper part forms a cover around the said pieces, with an opening to bring the fruit or vegetable to be prepared between the pressure piece and the receiving element.

Other features and advantages of the invention will appear from the following description of a particular embodiment of the invention; this description is given only as an example and does not limit the invention; reference numbers refer to the attached figures.

In the various figures, the same reference numbers refer to the same or to similar elements.

Figure 1:
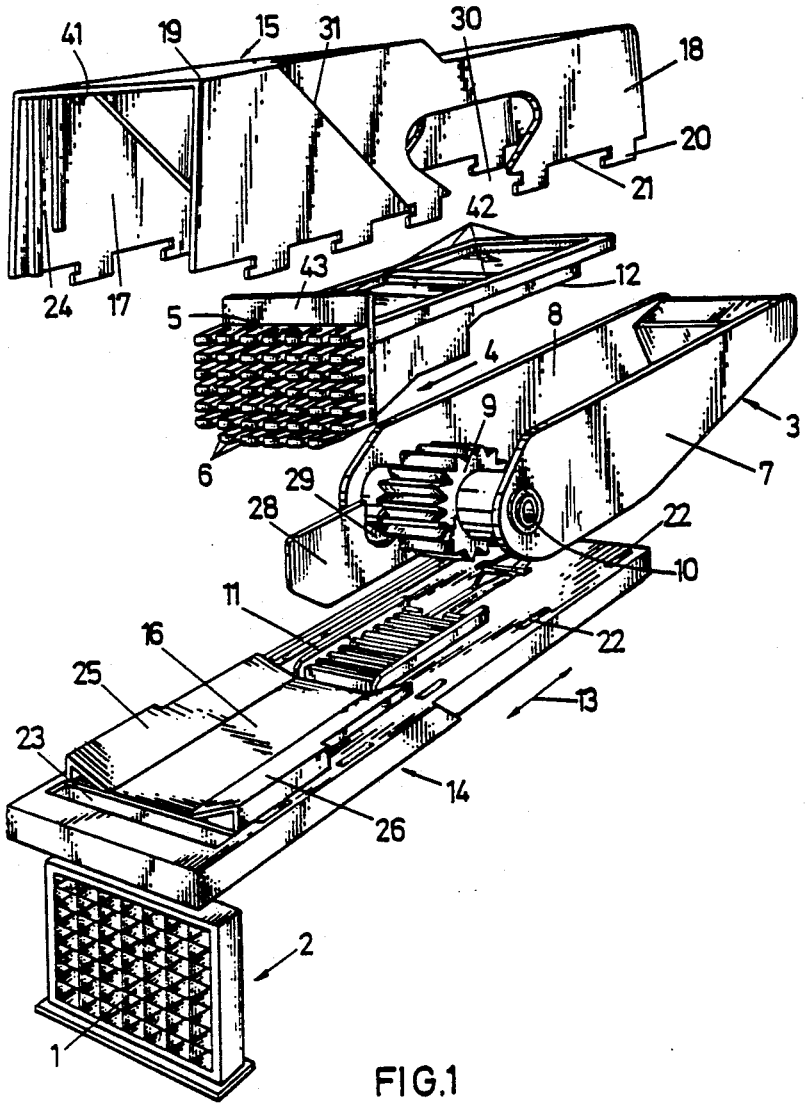
FIG. 1 is a view in perspective of the parts, in one type of design of the device according to the invention concerning the cutting of potatoes for French-frying.

The device, according to the invention concerning the preparation of fruit and vegetables, consists mainly in one mobile pressure piece and one receiving element, preferably fixed, against which the said pressure piece forces the fruit and vegetables being prepared. The movement of the pressure piece is controlled by a lever.

According to the invention, a driving mechanism is to be installed between the lever and the pressure piece, in order to reduce to a minimum the effort to be exerted on the lever for a given resultant effort on the pressure piece, and this for almost any position of the lever, taking into account the possibility of adapting this lever to suit a great variety of fruit and vegetables.

This driving mechanism consists in a toothed wheel moving freely between two racks parallel to the direction of the pressure piece, with one rack fixed in relation to the receiving element and the other fixed in relation to the pressure piece.

Although the following description refers only to a potato cutter, which is considered a major application of the invention, the scope of the invention extends to all kinds of devices for the preparation of fruit and vegetables, and the driving mechanism described above will be adapted accordingly.

The potato cutter made according to the invention and represented in FIGS. 1 to 4 shows a lattice 2 made from crossed steel wires 1, forming the receiving element mentioned above, and a mobile pressure piece 4 controlled by a lever 3, and having a pressure plate 5 which can be taken apart, on which are protrusions 6 matching the meshes formed by the crossing of the wires.

Lever 3 has two parallel arms 7 and 8, of which the free ends extend on both sides of a toothed wheel 9; these ends are affixed to the ends of axle 10 of toothed wheel 9. In a similar way, axle 10 is fixed in relation to toothed wheel 9, so that when lever 3 rotates around axle 10, the toothed wheel rotates correspondingly.

Toothed wheel 9 moves freely between two racks 11 and 12 parallel to the direction of movement 13 of the pressure piece 4. The lower rack is fixed in relation to lattice 2, while the upper rack is fixed in relation to pressure piece 4.

Toothed wheel 9 thus forms with both racks 11 and 12 the driving mechanism according to the above-mentioned invention.

This driving mechanism, the lattice and the pressure piece are mounted together in a housing made of two separate parts 14 and 15 placed one on top of the other. Lower part 14 makes an almost flat base on which is mounted fixed rack 11 and, extending beyond this rack, is a space 16 for the potato to be cut. Upper part 15 forms a cover with relatively high side walls 17 and 18, around the driving mechanism, the pressure piece and the lattice. Cover 15 has, on top, an opening to bring the potato to be cut between pressure piece 4 and lattice 2.

Cover 15 is mounted on base 14 by hook-shaped protrusions 20, along side walls 17 and 18, which can be hooked into grooves 22 along the longitudinal sides of base 14.

Protrusions 20 extend along the plane of side walls 17 and 18 in the direction of lattice 2 at one end of base 14. These protrusions 20 can therefore be hooked into matching grooves 22 which extend in the same direction by first bringing these hook-shaped protrusions 20 in matching grooves 22 and sliding on each other the cover and the base, so that protrusions 20 are firmly attached to base 14. These protrusions 20 on the cover form, with matching grooves 22 in the base, the means of fastening these two parts.

Base 14 and cover 15 are fixed in that position by lattice 2, which, under base 14 and through a matching seat 23 is slipped under the latter, on side 16 opposed to rack 11, up to a limit position, by slides 24, between side walls 17 and 18 of cover 15.

Lattice 2 is fixed in that position by an anchor nut 48 provided on the protruding rim 51 of base 14, along the trajectory of the lattice when it is slipped through sear 23 to its limit position by slides 24 of cover 15; this anchor nut 48 fits into a notch 49 provided in the extension 50 of lattice 2.

To center perfectly and automatically on base 14 the potato placed in space 16, in relation to lattice 2, the base has, on its two longitudinal sides, some centering surfaces 25 and 26, sloping outwards.

Figure 3:
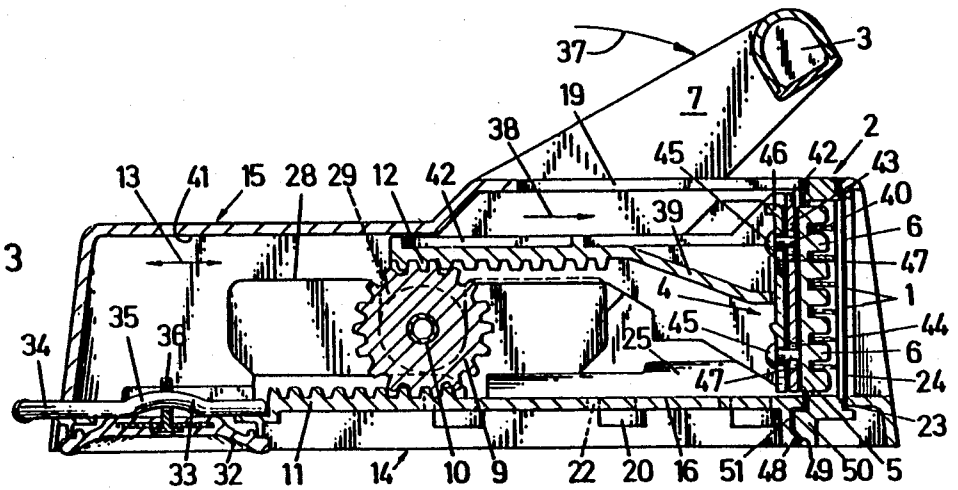
FIG. 3 is the same lengthwise section of the device in FIG. 1, in another position.

Cover 15 has, on its side, in side walls 17 and 18, two openings 30, facing each other, through which go the ends of the axle of toothed wheel 9. Arms 7 and 8 of lever 3 are fixed on these ends and extend on the outside of cover 15, along side walls 17 and 18. Inside each of these two side walls, opposite openings 30, is provided a small mobile plate 28 extending sidewise in relation to slide 11, with a notch 29 in which rests the respective free end of axle 10. The small plate 28 moves with toothed wheel 9 along a translation parallel to the direction of displacement of pressure piece 4. In this way, the space within which moves the driving mechanism is always completely closed by plate 28, providing a practical as well as an aesthetical advantage. The outside of these side walls has a slanting rib which stops the arms of lever 3 when the pressure piece is in its extreme position, in the area of lattice 2, as shown in FIG. 3.

While the teeth of toothed wheel 9 mesh with those of rack 12, the latter is submitted not only to a tangential force but also to an upwards non-tangential force, and is kept against toothed wheel 9 by the upper surface of cover 15. To this end, the side of rack 12 opposite toothed wheel 9, as well as the pressure piece 4 itself have vertical longitudinal walls 42 which slide against upper surface 41 and against inside of side walls 17 and 18 of cover 15. In this way, there is a continued meshing of rack 12 with toothed wheel 9 and the two racks 11 and 12 remain parallel to each other during displacement of toothed wheel 9. The cover thus serves also as a guide for pressure piece 4 while it goes forward and backward. Slanting surfaces of base 16 also provide guidance, but to a lesser degree.

Pressure plate 5 is mounted on support 43 in such a way that it can be removed from it, and fixed in relation to rack 12 by spindles 40 jutting out of pressure plate 5 and extending toward support 43. They fit into openings 44 in support 5. The free ends of spindles 40 jutting out in relation to support 43 have a head 45 behind which fits a movable bolt 46, sliding between two parallel ribs 52 and allowing to lock the pressure plate on the support. This bolt 46 have grooves 47 through which go also spindles 40 which are hooked by heads 45 in grooves 47, when bolt 46 moves. In this way, it is possible to provide lattices 2 with various size meshes and corresponding pressure plates, since lattice 2 as well as pressure plate 5 can easily be replaced.

Base 14 is provided, at the bottom, with a suction piece 32 of which the center part works with a lever mechanism to raise the said center part and fix it by suction to a work surface.

The lever mechanism consists in a lever 34 placed on top of suction piece 32 and pivoting in the plane of base 14. This lever 34 shows, above the center part of the suction piece, a curve 35 which, together with a connecting element 36, and while lever 34 rotates along a 180° angle, raises the center part of suction piece 32.

Figure 2:
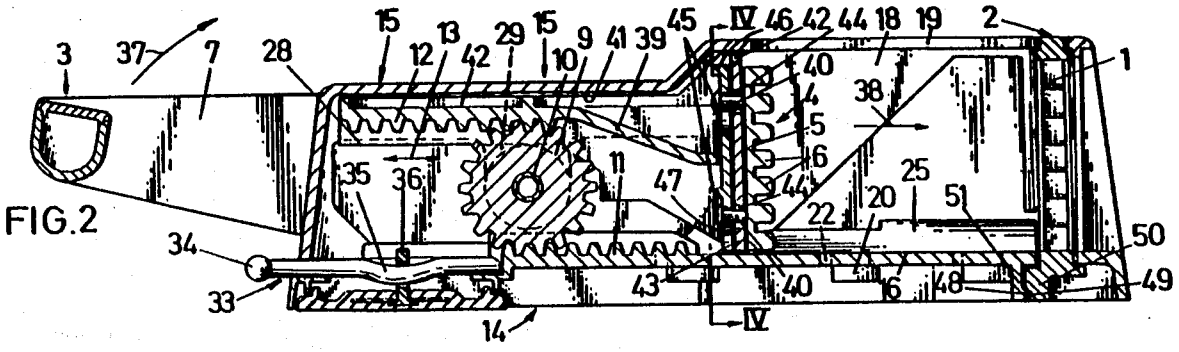
FIG. 2 is a lengthwise section of the device in FIG. 1, completely mounted in a given position.

The operation of the potato cutter thus described can be summarized as follows:

First the device is applied to a work surface, such as a table. By turning lever 34 the suction element fixes the device to the table. Then lever 3 is set at its lowest position, as shown in FIG. 2 which brings the pressure piece 4 in a position furthest from lattice 2. Then a potato is put, through opening 19, on space 16. Then lever 3 is moved following arrow 36 up to the position shown in FIG. 3.

While lever 3 is displaced, toothed wheel 9 moves along fixed rack 11 and gives to rack 12 a translation following arrow 38 toward lattice 2. During this displacement, rack 12 slides on cover 15. Rack 12 travels twice the distance covered by toothed wheel 9 on rack 11.

Figure 4:
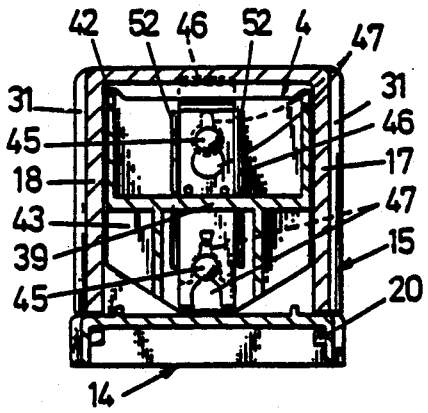
FIG. 4 is a cross section along line IV—IV of FIG. 2.
Figure 5:
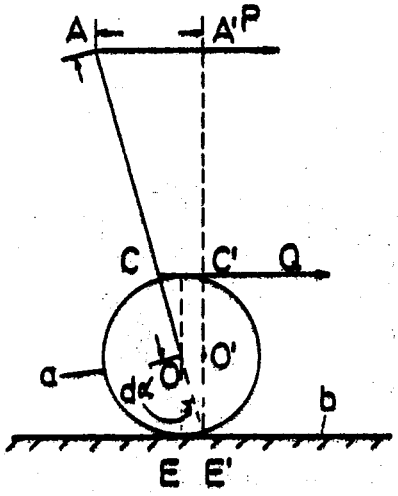
FIG. 5 is a schematic view of the kinetics of the mobile parts of the device, according to the invention.

The ratio between the force exerted on lever 3 and the force acting on pressure piece 4 can be calculated very simply using the schematic representation in FIG. 4, in which $a$ is the primary circle of toothed wheel 9, and $b$ is the primary plane of rack 11.

Line OA = L shows the length of lever 3 and $r$ is equal to the radius of primary circle $a$.

Let us suppose that at the end of lever 3 is applied a force P and that the resultant force on pressure piece 4 is equal to Q. Let us suppose further that by applying this force P, toothed wheel 9 is displaced along rack 11 by $EE' = dx$ for a corresponding angular displacement $d$. The result is a displacement $CC' = dy$ for pressure piece 4 and a displacement $AA' = dz$ for the free end lever 3.

At first approximation, friction losses can be neglected and according to the principle of the conservation energy $P\,dz = Q\,dy$ which gives $$P/Q = dy/dz = (2r\,dx)/(r + L)\,d = 2\,r/(r + L)$$

It is thus shown that ratio QP remains constant no matter what is the position of the lever. Theoretically, it would be preferable to choose as small a radius as possible for toothed wheel 9. However, this would decrease the travel of toothed wheel 12. There is therefore a minimum acceptable dimension for this diameter, which must be determined experimentally. It is also important that length L of lever be as great as possible and this length is determined by the acceptable dimensions of the device.

In this invention, base 14 and rack 11 are made of only one piece of injection moulded plastic. Other pieces made by injection are cover 15, toothed wheel 9 with its axle 10 and rack 12 of a piece with middle part 39 and pressure piece 4.

As shown in FIG. 1, the device can be easily taken apart without a screwdriver or any other tool. Therefore, the device can be cleaned easily after use.

The invention is not restricted to the embodiment described above and can be modified as regards shape, dimensions, number of elements and their relative position. Thus, for instance, the mobile pressure piece can be a lattice and the receiving element can be a wedged plate 6 corresponding to the meshes of the mobile lattice. The device can also be adapted to squeeze or cut other fruit or vegetables. In the latter case, the receiving element could be, for instance, a very fine mesh screen or a filter to let only juices go through.

I claim:

1. An apparatus for the preparation of food comprising:

a receiving element against which food may be forced;

a pressure piece mounted for movement relative to the receiving element for forcing food against the receiving element;

a first rack member mounted parallel to the direction of the movement of the pressure piece and attached to the pressure piece;

a second rack member mounted parallel to first rack member and attached to the receiving element;

a lever for controlling the movement of the pressure piece having a toothed wheel assembly at one end, the toothed wheel assembly engaging simultaneously with the first and second racks for rotational movement therebetween.

2. The apparatus of claim 1, wherein the pressure piece, receiving element, first and second rack members and toothed wheel assembly are mounted in a housing comprising an upper housing member and a lower housing member, the lower housing member forming the base upon which is mounted the second rack member and the upper housing member forming a detachable cover for the apparatus and providing an opening for introduction of food between the pressure piece and the receiving element.

3. The apparatus of claim 2, wherein the upper housing member is attached to the lower housing member by a means for mutual attachment of said members permitting relative displacement of the two attached members in only one direction.

4. The apparatus of claim 3, wherein the means for mutual attachment comprises hooking projections arranged in the same direction on the rim of the cover, and matching receiving slots in the base, whereby after insertion of said projections into said receiving slots, the relative displacement of the cover and the base in the said direction provides the mutual attachment of said cover and base.

5. The apparatus of claim 2, wherein the receiving element is attached to the base by an easily accessible anchor nut.

6. The apparatus of claim 2, wherein the first rack member is held in engaging position by the cover against the toothed wheel.

7. The apparatus of claim 6, wherein the first rack member and the pressure piece slide against the inside of the cover.

8. The apparatus of claim 2, wherein a suction assembly is attached to the base whereby a center suction part is controlled by a lever mechanism which allows the suction part to be raised to fix the base on a work surface.

9. The apparatus of claim 1, wherein the receiving element is a steel wire lattice and the pressure piece comprises a pressure plate arranged substantially parallel to the lattice, and provided with protrusions which extend through the meshes of the lattice when the pressure piece is moved into close relationship to the receiving element.

10. The apparatus of claim 1, wherein the pressure piece comprises a movable pressure plate extending in a plane perpendicular to its direction of movement and designed to mesh together with the receiving element.

11. The apparatus of claim 10, wherein a support member is attached to the first rack member, and the pressure piece is mounted on the support by means of jutting spindles provided on the side of the pressure plate and fitting openings in the support, whereby the free ends of the spindles jut out of the protrusions on the pressure piece and communicate with an anchor nut on the said free ends of the protrusions.

12. The apparatus of claim 1, wherein all components are comprised of a plastic material.

13. The apparatus of claim 2, wherein the lever comprises two parallel arms attached to the opposite ends of an axle carrying said toothed wheel and extending radially outward from said axle.

14. The apparatus of claim 13, wherein each end of the axle of the toothed wheel assembly extends through an opening in the cover and the extending arms of the lever are attached to the axle ends outside of the cover.

* * * * *